US012253279B1

(12) United States Patent
West

(10) Patent No.: US 12,253,279 B1
(45) Date of Patent: Mar. 18, 2025

(54) AIR CONDITIONER WITH SELECTIVELY ACTIVATED COIL SEGMENTS FOR INCREASED DEHUMIDIFICATION AND EFFICIENCY

(71) Applicant: Advantek Consulting Engineering, Inc., Melbourne, FL (US)

(72) Inventor: Michael Kenneth West, Melbourne, FL (US)

(73) Assignee: Advantek Consulting Engineering Inc., Melbourne, FL (US)

( * ) Notice: Subject to any disclaimer, the term of this patent is extended or adjusted under 35 U.S.C. 154(b) by 223 days.

(21) Appl. No.: 17/178,020

(22) Filed: Feb. 17, 2021

Related U.S. Application Data

(60) Provisional application No. 62/978,470, filed on Feb. 19, 2020.

(51) Int. Cl.
*F24F 3/14* (2006.01)
*F24F 1/028* (2019.01)
(Continued)

(52) U.S. Cl.
CPC ..... *F24F 3/1405* (2013.01); *F24F 1/028* (2019.02); *F25B 43/006* (2013.01); *F24F 3/147* (2013.01);
(Continued)

(58) Field of Classification Search
CPC ..... F24F 3/147; F24F 1/028; F24F 2110/10; F24F 2110/20; F24F 1/032; F24F 1/0323;
(Continued)

(56) References Cited

U.S. PATENT DOCUMENTS 2,236,058 A 3/1941 Henney
2,249,856 A * 7/1941 Ruff ..... F24F 3/1405 236/44 R
(Continued)

FOREIGN PATENT DOCUMENTS

EP 0217605 A2 * 4/1987 ..... B60H 1/00485
FR 2987886 A3 * 9/2013 ..... B60H 1/00278
JP 54040351 A * 3/1979 ..... F25B 1/00

OTHER PUBLICATIONS

Hansen Technologies, Specifications, Applications, Service Instructions & Parts—S Series Refridgerant Level Transducer Probes—0-5 or 1-6 Volt DC Output for Vertical or Horizontal Receivers, Bulletin P112c, Burr Ridge, USA, Nov. 2019, 4 pages.

*Primary Examiner* — Tho V Duong
*Assistant Examiner* — For K Ling
(74) *Attorney, Agent, or Firm* — Brian S. Steinberger; Hilary F. Steinberger; Steinberger IP Law

(57) ABSTRACT

Systems, apparatus and methods for independently reducing temperature and humidity of air in a controlled space to meet separate temperature and humidity control set points. A preferred system can include a compressor, a condenser connected to the compressor to provide a liquid refrigerant flow, a controllable segmented heat-exchanger coil for controlling relative flow of coolant to active segments for cooling airflow so that adjustable humidity and temperature control is provided for the controlled space, the active coil segments being stacked and parallel, a liquid-suction heat-exchanger separator to provide increased dehumidification and efficiency, increased refrigerant vapor density, and reduced condenser pressure, and a liquid level sensor attached to the liquid-suction heat-exchanger separator to realize evaporator coil freezing temperature for dehumidification, along with preventing liquid refrigerant entering the
(Continued)

compressor, while providing unevaporated liquid refrigerant flow from the outlet of the heat-exchanger coil.

10 Claims, 12 Drawing Sheets

(51) Int. Cl.
*F24F 3/147* (2006.01)
*F24F 110/10* (2018.01)
*F24F 110/20* (2018.01)
*F25B 43/00* (2006.01)

(52) U.S. Cl.
CPC ..... *F24F 2110/10* (2018.01); *F24F 2110/20* (2018.01)

(58) Field of Classification Search
CPC ..... F24F 1/0063; F24F 3/065; F24F 3/153; F24F 11/87; F24F 11/89; F24F 2003/144; F28D 1/0408; F28D 1/0407; F28D 1/0452; F28D 1/0443; F25B 2400/23; F25B 2400/051; F25B 43/006; F25B 2600/05; F25B 2700/03; F25B 41/48; F25B 5/02
See application file for complete search history.

(56) References Cited

U.S. PATENT DOCUMENTS 2,296,530 A 9/1942 McGrath
2,451,385 A 10/1948 Groat
2,685,433 A 8/1954 Wintermann
2,926,503 A * 3/1960 Neubauer ..... F24F 3/153 62/278
3,251,196 A 5/1966 Watkins
3,402,564 A * 9/1968 Nussbaum ..... F24F 3/153 62/196.2
3,600,904 A * 8/1971 Tilney ..... F25B 41/315 62/503
3,721,104 A * 3/1973 Adler ..... F25B 49/02 62/503
3,938,348 A 2/1976 Rickert
4,003,729 A 1/1977 McGrath
4,105,063 A 8/1978 Bergt
4,182,133 A 1/1980 Haas et al.
4,350,023 A 9/1982 Kuwabara
4,428,205 A 1/1984 Doderer
4,448,597 A 5/1984 Kuwabara et al.
4,485,642 A 12/1984 Karns
4,889,280 A 12/1989 Grald et al.
4,984,433 A 1/1991 Worthington
5,195,473 A 3/1993 Kano et al.
5,303,561 A 4/1994 Bahel et al.
5,346,127 A 9/1994 Creighton
5,346,129 A 9/1994 Shah et al.
5,622,055 A * 4/1997 Mei ..... F25B 43/006 62/503
5,622,057 A 4/1997 Bussjager et al.
5,752,389 A * 5/1998 Harper ..... F24F 11/88 62/176.5
5,752,391 A * 5/1998 Ozaki ..... F25B 1/04 62/208
5,802,862 A 9/1998 Eiermann
5,850,968 A 12/1998 Jokinen
6,105,387 A * 8/2000 Hong ..... B60H 1/323 62/176.1
6,253,572 B1 7/2001 Bottum, Sr. et al.
6,427,454 B1 * 8/2002 West ..... G05D 22/02 62/93
6,463,757 B1 10/2002 Dickson et al.
6,644,049 B2 * 11/2003 Alford ..... F24F 3/1405 62/90
7,845,185 B2 * 12/2010 Knight ..... F24F 3/153 62/196.4
9,188,369 B2 * 11/2015 Kuehl ..... F25B 5/02
9,261,542 B1 2/2016 West
9,574,810 B1 2/2017 West
9,958,190 B2 5/2018 West
10,203,122 B2 2/2019 Hasegawa et al.
10,823,473 B2 11/2020 West
10,834,855 B2 11/2020 Ghadiri Moghaddam et al.
2006/0213220 A1 * 9/2006 Takahashi ..... B60H 1/3227 62/503
2013/0255307 A1 * 10/2013 Kuehl ..... F25B 5/02 62/524
2014/0318170 A1 * 10/2014 Katoh ..... F25B 6/00 62/324.5
2015/0226472 A1 * 8/2015 Scherer ..... F28D 1/0477 62/115
2017/0336145 A1 * 11/2017 Nakamura ..... F28F 13/06
2018/0363965 A1 * 12/2018 Hayamizu ..... F25B 31/008
2020/0173673 A1 6/2020 Goel et al.
2020/0378637 A1 12/2020 Xi et al.
2021/0108857 A1 * 4/2021 Thobias ..... F28D 1/0477

* cited by examiner

AIR CONDITIONER WITH SELECTIVELY ACTIVATED COIL SEGMENTS FOR INCREASED DEHUMIDIFICATION AND EFFICIENCY

CROSS REFERENCE TO RELATED APPLICATIONS

This application which claims the benefit of priority to U.S. Provisional Application Ser. No. 62/978,470 filed Feb. 19, 2020. The entire disclosure of each of the applications listed in this paragraph are incorporated herein by specific reference thereto.

FIELD OF INVENTION

The present invention relates to systems, apparatus and methods for independently reducing the temperature and the humidity of air in a controlled space to meet separate temperature and humidity control set points. The invention provides increased energy efficiency and increased humidity removal capability by maximizing latent cooling along with preserving as much sensible heat as possible from the space air to reduce over-cooling, which greatly reduces or eliminates the need for energy intensive reheating and/or additional cooling or heating coils.

BACKGROUND

Various air conditioning systems and controls for adjusting air conditioning equipment to achieve a desired comfort zone, by controlling temperature and humidity levels, have been proposed. Such apparatus is shown in numerous patents described below. Known air conditioning systems typically use a chilled fluid or a circulating refrigerant in a heat exchange coil to cool and dehumidify air before it flows into an indoor controlled space. Temperature reduction is commonly known as sensible cooling, and humidity reduction is known as latent cooling. Air temperature is reduced by sensible cooling, and when the temperature of the air is reduced below its dew point, moisture condenses out of the air, providing latent cooling that dehumidifies the space air.

The rate of cooling provided by some systems, including chilled fluid systems, may be varied in response to a thermostat placed within the indoor space being conditioned. Variations in the rate of cooling can occur in a manner to maintain a chosen temperature set point at the thermostat. In other known systems, including split-systems and package units, the air conditioning system compressor may turn on and off in response to the thermostat temperature set point.

In recent years, some manufacturers have incorporated humidity sensing into their controls. Dehumidification is typically provided as a passive byproduct of cooling, and has been accomplished by cancelling out the sensible portion of cooling using reheat, where the temperature of the air exiting the heat-exchanger coil is raised, leaving the latent portion for dehumidification. Heating of air after energy has been expended to cool the air is costly and wasteful.

Humidity control has been indirectly accomplished through reduction of the indoor temperature set point or calculation of a comfort condition based on a combined indoor temperature-humidity setting rather than through a control strategy based on user selectable separate temperature and humidity setpoints that control the proportions of sensible and latent cooling provided by the cooling apparatus.

It has long been recognized that proper air conditioning systems should not only lower the temperature of the interior space being served when the temperature therein has exceeded a predetermined level, but should also control the relative humidity of the space as a function of the air conditioning. During operation of a typical air conditioning system, air from the space to be conditioned is circulated through a heat exchange coil. The heat-exchanger coil absorbs heat energy from the air, lowering its dry bulb temperature. If the temperature of the air is lowered below its dew point, moisture from the air is condensed onto the heat-exchanger coil surfaces and the actual amount of moisture contained in the air is reduced.

Typical air conditioning systems provide a small amount of dehumidification passively as a byproduct of cooling. In typical systems, the amount of dehumidification delivered by the system is not sensed, controlled, or responsive to the user's needs. Most known systems control the amount of cooling delivered by the heat exchange coil, but not the amount of dehumidification. The space temperature or temperature of the room, for example, is maintained within a degree of the user's setting. However, the space humidity typically swings up and down as temperature varies. At times of low load and humid conditions, this swing in space humidity can be plus or minus 20% relative humidity resulting in space humidity levels that exceed the maximum comfort levels of 60-70% relative humidity recommended by ASHRAE (American Society of Heating, Air Conditioning, and Refrigeration Engineers). Supply duct humidity typically exceeds 95% relative humidity in such systems. The maximum recommended humidity level for supply ducts is 70% relative humidity to prevent fungal growth.

Present day air-conditioning systems have not adequately addressed these problems in a practical, energy efficient, and cost-effective manner. Most systems rely on reheat to cancel the sensible cooling portion, which requires additional components and increased energy costs. U.S. Pat. No. 5,802,862 to Eiermann describes a combined, reheat coil runaround system. U.S. Pat. No. 4,350,023 to Kuwabara et al. and U.S. Pat. No. 4,448,597 to Kuwabara et al. describes a control scheme for a reheat apparatus that has an additional coil located downstream of the evaporator coil, referred to as a sub-condenser. A similar arrangement is described in U.S. Pat. No. 4,182,133 to Haas et al, which uses one coil with multiple circuits, and in U.S. Pat. No. 5,622,057 to Bussjager et al. One of the earliest examples of reheat is described in U.S. Pat. No. 2,451,385 to Groat, with a variation described in U.S. Pat. No. 2,685,433 to Wintermann, in which first cooling and then heating are sequentially provided through separate air streams. By its very nature, heating air after considerable energy has been expended to cool the air is wasteful and results in significantly increased energy expense. The additional heat exchanger coils that are required make such systems are expensive to install and difficult to maintain.

Reheat can be provided with no additional energy expense by exchanging heat from the air entering the coiling coil to the air exiting the cooling coil, as described in U.S. Pat. No. 4,428,205 to Doderer. A current example of this technology is wrap-around heat pipes, which significantly increase equipment cost and physical size and weight.

U.S. Pat. No. 4,984,433 to Worthington describes an air conditioning system with a variable sensible heat ratio. The system includes a variable speed supply air fan and a plurality of subcooling coils. The controller senses temperature and humidity and tracks their change over time to predict if the latent and sensible needs will be satisfied simultaneously. When it is desired to remove more latent heat than sensible heat, the supply air fan speed is reduced and subcoolers are activated. As with previous inventions of this type, energy waste, control complexity, and the problems of coil freezing and liquid entering the compressor are not solved.

U.S. Pat. No. 3,938,348 to Rickert describes a unit in which an evaporator coil is maintained at a selected cooling or dew point temperature constantly, regardless of whether cooling is required. The compressor may be turned on and off or may be a two-speed, or two compressors may be used to constantly maintain the evaporator at a selected temperature.

U.S. Pat. No. 5,346,127 to Creighton describes an air handler arrangement where air flow through the coil is varied, according to the sensible load, via face and bypass dampers. The arrangement actively meets the sensible cooling load, but may not provide adequate dehumidification. Similarly, U.S. Pat. No. 4,485,642 to Karns describes a heat exchanger air bypass for humidity control by a manually set damper apportioning the air flowing through the heat exchanged and bypassing the heat exchanger.

U.S. Pat. No. 5,303,561 to Bahel describes a controller that produces a slower fan speed when conditions are humid, based on temperature and humidity sensors. The system modulates the indoor fan speed to attempt to stay within the comfort envelope defined by combined relative humidity and temperature measurements. Dehumidification capability is limited by the degree to which airflow can be reduced without causing air stagnation and condensation in the occupied space.

Other examples are disclosed in U.S. Pat. No. 2,236,058, to Henney which describes a variable speed fan; U.S. Pat. No. 2,296,530 to McGrath which describes a face damper only; U.S. Pat. No. 2,685,433 to Wintermann; U.S. Pat. No. 3,251,196 to Watkins which describes three staged fans; and U.S. Pat. No. 4,003,729 to McGrath, which describes a variable speed fan in conjunction with a coil temperature sensor.

U.S. Pat. No. 5,346,129 to Shal et al. describes a controller that starts a condensing unit in response to an error signal that is a combination of temperature and humidity. Another combined controller is described in U.S. Pat. No. 5,850,968 to Jokinen, which is a comfort controller replacement for a conventional thermostat. U.S. Pat. No. 4,105,063 to Bergt discloses an air conditioning system with a sensor responsive to a predetermined maximum moisture content, operated in parallel with the normal dry-bulb temperature control. U.S. Pat. No. 4,889,280 to Grald discloses an auctioning controller wherein the predetermined dry-bulb temperature set point is modified in response to an absolute humidity error signal. Another controller is described in U.S. Pat. No. 5,915,473 to Ganesh et al., which operates a system having an HVAC control and a humidity limiting control.

More recently, U.S. Pat. No. 10,203,122 to Hasegawa et al. discloses an air-conditioning coil that changes cooling capacity according to six discrete combinations of outdoor temperature and humidity, such that absolute humidity of supply air becomes equal to or lower than indoor target absolute humidity. Cooling capacity of the coil is changed by changing the refrigerant superheat control target, which is met by adjusting a refrigerant flow-rate regulation unit. The embodiment includes a heat exchanger bypass damper that is opened when the air-conditioning coil is turned off. The approach is wholly different from the presently disclosed invention.

Application U.S. No. 2020/0173673 by Goel et al. follows U.S. Pat. No. 6,427,454, which show a bypass damper that can be opened to allow a portion of air to flow around a heat exchange coil when relative humidity of the conditioned space is above a threshold set point humidity level. U.S. Pat. No. 10,834,855 to Moghaddam et al, shows a heat exchanger coil with a bypass damper that causes air to bypass the coil according to outdoor air conditions. The present invention eliminates the need for a bypass damper.

Published Patent Application 2020/0378637 by Zhanli XI et al. describes a controller that sets the cooling coil temperature to equal the dew point temperature of the indoor space, which is calculated from the indoor temperature and relative humidity. The cooling coil temperature is lowered by decreasing the fan speed and also by lowering the compressor speed depending on the indoor temperature in relation to the set point. The application mentions control of a dehumidification valve, which directs part of the warm liquid refrigerant flowing from the condenser to circuits of the indoor coil for reheating the air after it is cooled. This is essentially a system that reheats air to provide dehumidification. Excessive energy consumption, limited dehumidification capability, complexity, expense, and/or risk of compressor damage have limited the practicality of most of the available systems that address dehumidification. Thus, the need exists for an improved solution to the above problems with the prior art.

SUMMARY OF THE INVENTION

A primary objective of the present invention is to provide systems, apparatus and methods for reducing level of humidity in a controlled space independently of temperature, while using return or ambient air from the controlled space to prevent over cooling and under ventilation of the controlled space.

A secondary objective of the present invention is to provide systems, apparatus and methods for maximum humidity removal capability and energy efficiency in a controlled space with independent humidity control by maximizing latent cooling and limiting sensible cooling without using energy intensive reheating of the space and/or additional heat exchanger coils.

The present invention features (1) a heat-exchanger cooling coil having individually controllable segments that can be activated or deactivated to change the portions of sensible and latent cooling provided; (2) a refrigerant liquid-suction heat-exchanger separator that lowers the enthalpy of the refrigerant entering the active heat-exchanger cooling coil segments, allows liquid refrigerant to flow through the entirety of the evaporator coil, and prevents liquid refrigerant from entering the compressor; (3) a space comfort controller having separate temperature and humidity setpoints whereby heat-exchanger cooling coil segments are activated or deactivated; and (4) a refrigerant flow controller having a setpoint whereby the active heat-exchanger cooling coil segments flow unevaporated liquid refrigerant from inlet to outlet.

Further objectives and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1A:
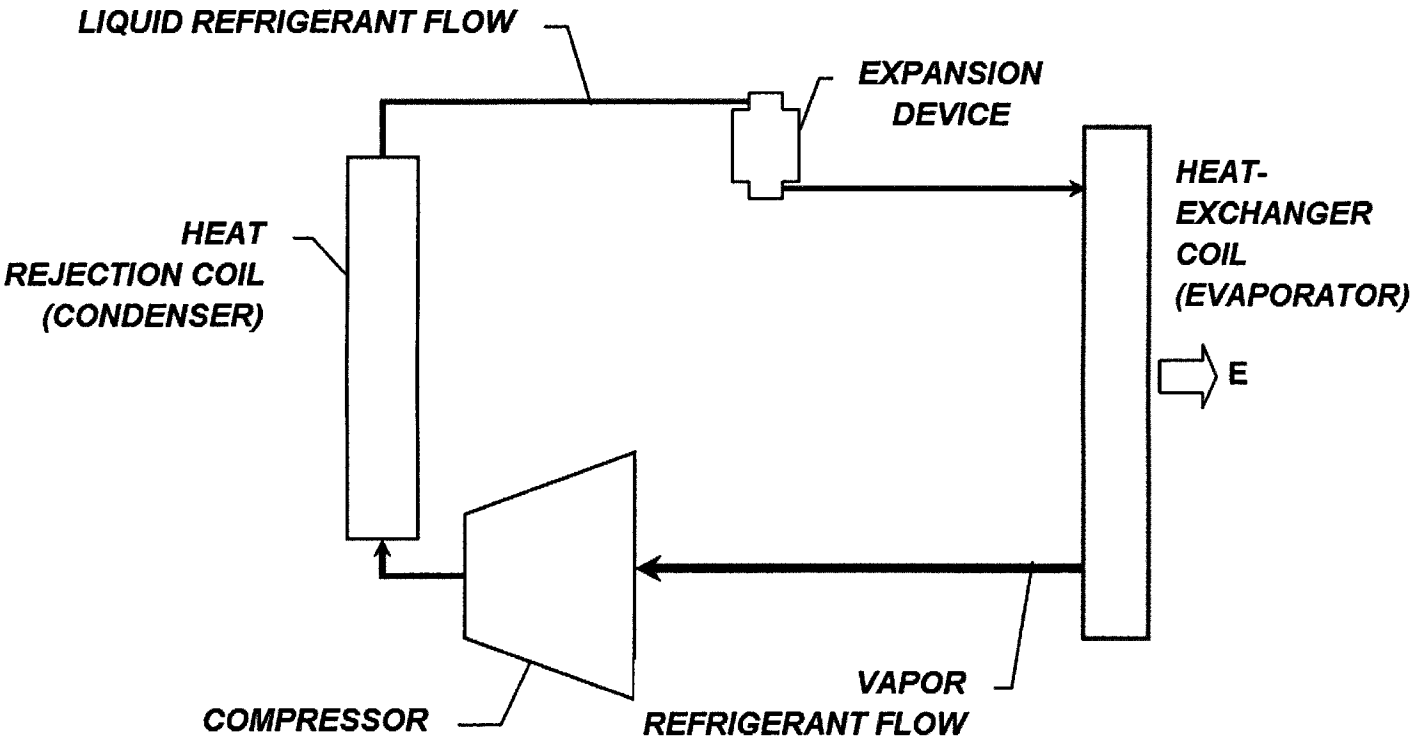
FIGURE 1A (PRIOR ART)
FIG. 1A is a prior art view of an arrangement of typical refrigeration components.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

In this detailed description of the present invention, a person skilled in the art should note that directional terms, such as "above", "below"," upper "," lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally"," substantially ", "mostly", and other terms are used, in general, to mean that the referred to object, characteristic, or quality constitutes a majority of the subject of the reference. The meaning of any of these terms is dependent upon the context within which it is used, and the meaning may be expressly modified.

The inventor of the subject patent application has worked on Air Conditioner Systems as shown in U.S. Pat. Nos. 6,427,454; 9,574,810; 9,958,190 and 10,823,473 to West which are all incorporated by reference in their entirety.

The present invention herein discloses a controllable segmented heat-exchanger coil used with a combination liquid-suction heat-exchanger separator over U.S. Pat. No. 6,427,454 to West, which discloses use of a bypass damper with a liquid-suction heat exchanger with no separator.

Additionally, the present invention discloses control of refrigerant flow according to the refrigerant level in the liquid separator, rather than by a traditional thermostatic expansion valve. In one embodiment, the present invention can be used with the optimizing feedback controller described in U.S. Pat. Nos. 9,574,810 and 10,823,473.

An embodiment of the invention, as shown and described by the various figures and accompanying text, provides an air conditioning system having a heat-exchanger coil with a plurality of segments, each having one or more separate inlets and outlets. One or more valves control the flow of refrigerant through each segment. A liquid-suction heat-exchanger separator may be utilized as well. The system can utilize a controller response to the temperature and humidity of the conditioned space.

A LIST OF COMPONENTS WILL NOW BE DESCRIBED

1 Direct Expansion type Refrigeration Circuit
2. Partition
10 Liquid Refrigerant Flow

20 Liquid-Suction Heat-Exchanger Separator
30 Refrigerant Compressor, such as but not limited to Copeland scroll model ZP120KCE-TF5
40 Heat Rejection Coil (Condenser), such as but not limited to Carrier 30RA400082
50 Expansion Device (TXV, FCCV, or Orifice), such as but not limited to Trane VAL09406
60 Temperature/Pressure Sensor, such as but not limited to Sensata 112CP3-9
65 electronic Liquid-level Sensor, such as but not limited to Hansen SHP08
75 Mixed Liquid+Vapor Refrigerant Flow
80 Coil Segment Activators (Valves), such as but not limited to Carrier 99053
80A Optional Center Segment Valve
80B Upper Segment Valve
80C Optional Lower Segment Valve
70 Heat-exchanger Coil (Evaporator)
100 Closed Space Embodiment (Air Handling Unit)
110 Air Filter(s), such as but not limited to AirGuard DP-13
120 Output Mixing Plenum
130 Supply Fan (Blower), such as but not limited to Rheem AS-61697
140 Supply Fan Motor, such as but not limited to Trane MOT9801
150 Condensate Collection Pan (Drain Pan)
160 Heating Coil, such as but not limited to Trane BAYHTR1510
500 Controller
510 Controller CPU
520 Controller Terminal Strip
530 Controller Humidity Sensor
540 Controller Temperature Sensor
550 Control panel
560 Temperature set point controls
570 Humidity set point controls FIG. 1A is a prior art view of a typical and well known standard arrangement of refrigeration components with a heat rejection coil (condenser) with liquid refrigerant flow to an expansion device and heat-exchanger coil (evaporator), that provides vapor refrigerant flow to a compressor returning to the heat rejection coil (condenser).

Figure 1B:
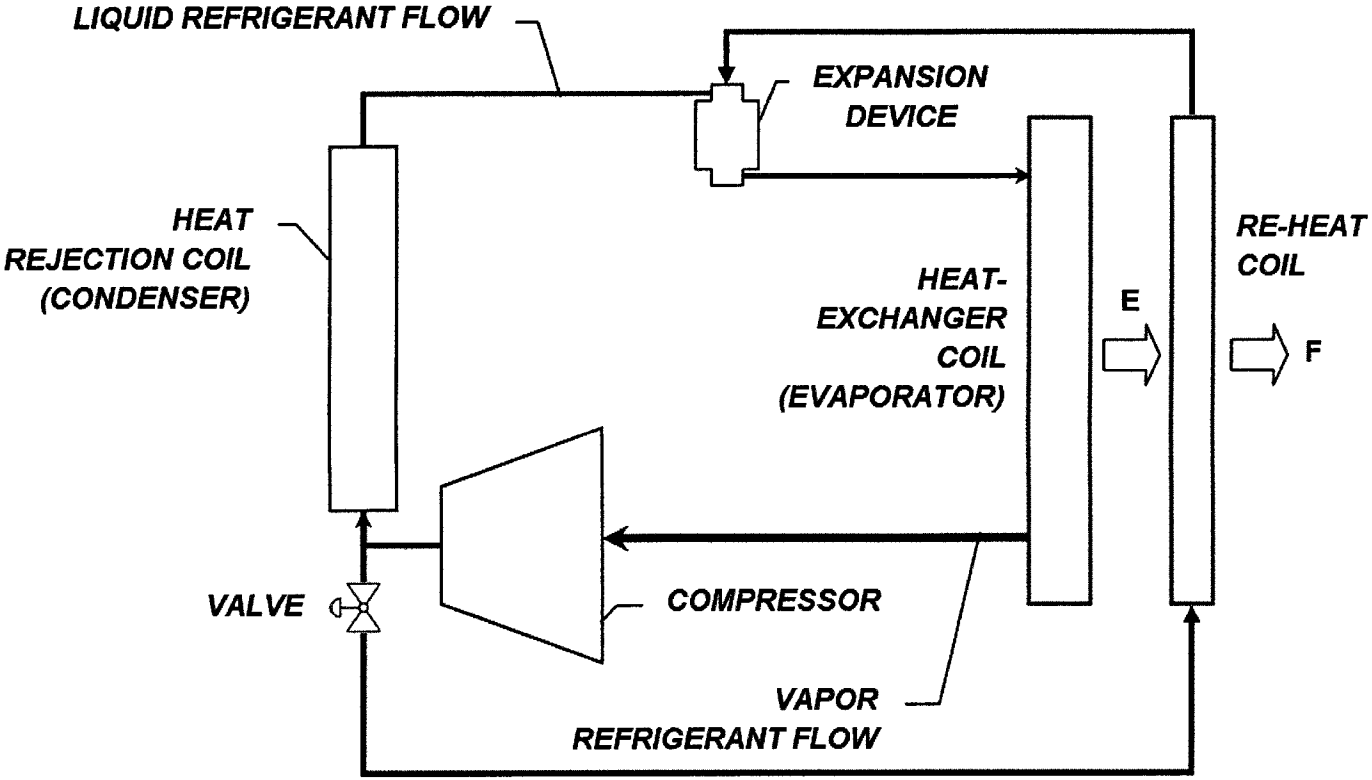
FIGURE 1B (PRIOR ART)
FIG. 1B is a prior art view of an arrangement of typical refrigeration components shown in FIG. 1A along with a RE-HEAT COIL

FIG. 1B is a prior art view of an arrangement of typical refrigeration components shown in FIG. 1A along with a RE-HEAT COIL used for dehumidification by cancelling the sensible portion of cooling provide by the heat-exchanger coil.

Figure 1:
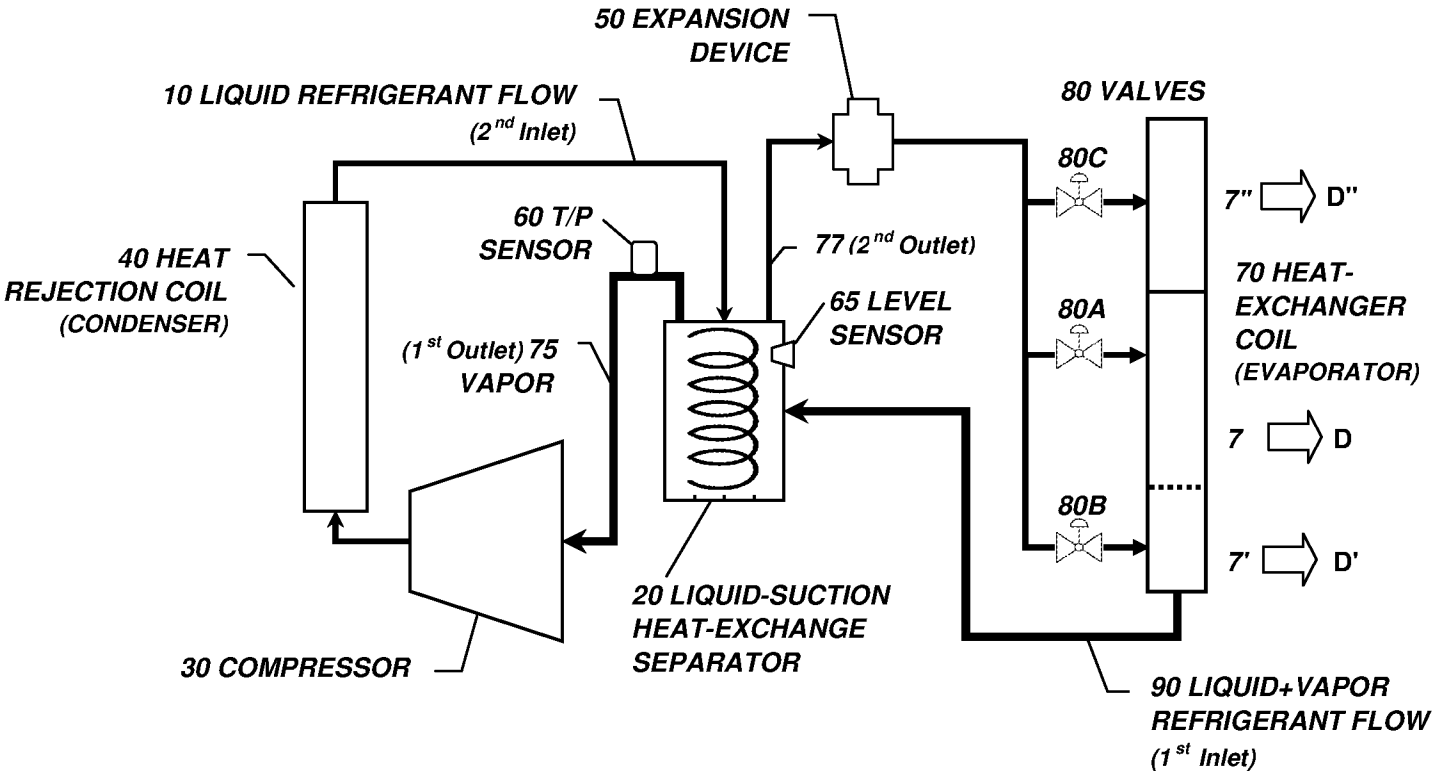
FIG. 1 is a schematic of the refrigeration circuit components of an embodiment of a direct expansion type air-conditioning or refrigeration system, according to one embodiment of the present invention, used in connection with the segmented heat-exchanger coil segments depicted in FIG. 2A and FIG. 2B.

FIG. 1 is a schematic diagram of the refrigeration components of an embodiment of a direct expansion type system according to the present invention. Referring to FIG. 1, the combination of components provides (i) lower than conventional superheating of the refrigerant vapor as it flows from 90 to 75 before entering the compressor 30 and (ii) greater than conventional subcooling of the refrigerant liquid 10 as it flows through the spiral tube coil of liquid-suction heat exchanger 20 and enter the expansion device 50. This is acheived with a liquid-suction heat-exchanger separator 20 combined with control of expansion device 50, via temperature-presure sensor 60 and/or liquid level sensor 65, in one of three arrangements, as follows: In one arangement the degree of superheat of refrigerant flow 75 is sensed by temperature-pressure (T/P) sensor 60, and the expansion device 50 is controlled so that this degree of superheat is approaching zero. In a second arrangement the amount of liquid in the vessel of the liquid-suction heat-exchanger separator 20 is sensed by liquid level sensor 65, and the expansion device 50 is controlled so that the flow of liquid is increased when level of the liquid in the vessel is under-filled and inadequate, and the flow of liquid is decreased when level sensor 65 senses the amount of the liquid in the vessel is over-filled. The level sensor 65 is used for controlling the liquid in the vessel to be adequately but not over filled. A third arrangement uses both a temperature-pressure sensor and a liquid level sensor to control the expansion device 50 so that flow 75 entering the compressor 30 approaches zero degrees superheat. This combination serves to realize the coldest possible evaporator coil (segmented heat exchanger) temperature before freezing and thus maxiumum dehumidification by ensuring there is a substantial flow of cold liquid refrigerant both entering the cooling coil from expansion device 50 and exiting the cooling coil at 90. It also provides minimal risk of liquid refrigerant entering the compressor by ensuring all liquid in flow 90 is separated and evaporated in liquid-suction heat-exchanger spearator 20. And, reduced condenser pressure and increased refrigerant vapor density are realized by providing refrigerant to approach zero superheat entering compressor 30, which combine to improve energy efficiency and compressor longevity compared with known systems.

As air flows past heat-exchanger coil segments 7, 7', and 7" of heat-exchanger Coil (Evaporator) 70, refrigerant, if present, in the coil segment(s) evaporates, thus absorbing its latent heat of vaporization from the air, which cools the air.

This refrigerant vapor exits the active heat-exchanger coil segments 7, 7', and/or 7" of heat-exchanger coil (Evaporator) 70 along refrigerant flow path 90 and enters the low pressure circuit of liquid-suction heat-exchanger separator 20 where heat is transferred to flow 90 from the liquid refrigerant flow 10, vaporizing and superheating the liquid in the refrigerant mixture, which is then separated into vapor flow 75.

The separated refrigerant vapor 75 then enters compressor 30, where its pressure and temperature are increased, and then flows through heat rejection coil (Condensor) 40, where it partially or fully condenses from a superheated vapor into a saturated or sub-cooled liquid, releasing the heat that was absorbed in heat-exchanger coil (Evaporator) 70, active segments 7, 7', and/or 7", liquid-suction heat-exchanger separator 20, and compressor 30. The refrigerant flows along path 10 into the high pressure circuit of liquid-suction heat-exchanger separator 20 where it is further condensed and/or subcooled by way of the transfer of heat to refrigerant along path 90 into the liquid-suction heat-exchanger separator 20. Refrigerant then enters expansion device 50 where its pressure and temperature are reduced.

The liquid-suction heat-exchanger separator 20 is structurally similar to accumulators shown and described in U.S. Pat. No. 6,253,572 to Bottum, Sr. et Jr. and U.S. Pat. No. 6,463,757 to Dickson et al., which are both incorporated by reference in their entirety, but but structurally differs by having four tube connections rather than two connections, and functionally differs by having increased heat transfer over prior art and performing the fucntion of separating liquid from vapor rather than accumulating excess liquid as does prior art.

In one embodiment of the invention, one expansion device 50 can meter the flow rate of refrigerant into all active heat-exchanger coil segements 7', or 7 and 7' or 7, 7', and 7" of heat-exchanger coil (Evaporator) 70 according to the refrigerant pressure and/or temperature at sensor port 60 so that the flow rate, and thus the pressure, is reduced when refrigerant flow is not sufficiently superheated, and the flow rate is increased as the superheat becomes adequate.

In another embodiment of the invention, the flow rate into the active heat-exchanger coil segments can be metered by one or more expansion devices 50 according to the separator liquid level obtained at sensor port 65, such that the flow rate, and thus the liquid level, is increased when the liquid level is inadequate, and the flow rate is decreased as the liquid level becomes adequate. Adjustment of expansion device 50 can be by mechanical spring/diaphragm, known as a thermostatic expanson valve, or alternatively, adjustment of expansion device 50 can be by electronic stepper motor, known as an electronic expansion valve to those skilled in the art. There may be one expansion device for all heat-exchanger segments, and/or any segment may have a dedicated expansion device.

The liquid-suction heat-exchanger separator 20 can be provided by a vessel with a number of inlet and an outlet tubes, including an inlet tube for passing a mixture of liquid and vapor refrigerant 90 ($1^{st}$ Inlet) into the vessel, and a 1st outlet tube 75 at the top of the vessel for passing refrigerant gas out of the vessel to the compressor 30. The mixture of the liquid and vapor refrigerant entering the vessel can be separated by gravity whereby denser liquid separates to the bottom of the vessel and lighter vapor moves to the top of the vessel. A second inlet tube 10 of liquid-suction heat-exchanger separator 20 passes liquid, or a mixture of liquid and vapor refrigerant from path 10 into a hollow coil tube spiraled between the top and bottom of the vessel. A second outlet tube 77 passes subooled liquid refrigerant out of the hollow spiraled coil tube to expansion device 50.

The walls of the tube can be grooved to enhance heat transfer, as known to one skilled in the art. Refrigerant flowing between condenser 40 and expansion device 50 in refrigeration system 1 is passed through the hollow spiraled coil tube, contained within the vessel of liquid-suction heat-exchanger 20 to subcool it, while refrigerant liquid+vapor mixture flowing from the active 7, 7', 7" heat-exchanger coil (Evaporator) 70 segments to compressor 30 is passed through the vessel of liquid-suction heat-exchanger 20 to both evaporate the liquid and separate the vapor.

The inlets and outlets of liquid-suction heat-exchanger separator 20 can be at different levels. This can cause a greater amount of liquid refrigerant to remain in the vessel during reverse cycle heat pump operation than would remain during cooling, thereby increasing heat transfer as required for the greater volume of liquid in flow 90 and compensating for the decreased quantity of refrigerant needed for heating.

FIG. 1A is shown to further convey the scope of the invention to those skilled in the art by illustrating the refrigeration components typical of prior art for comparison with FIG. 1. Missing from FIG. 1A are the components of the present invention shown in FIG. 1, thus the arrangement of FIG. 1A provides mostly sensible cooling along with a small portion of latent dehumidification as a passive byproduct.

Likewise, FIG. 1B shows the arrangement of refrigeration components typical of prior art utilizing reheat to cancel the sensible cooling portion to address a need for dehumidification, FIG. 1B shows the components of FIG. 1A with the addition of a reheat coil, which is missing the innovations of the present invention shown in FIG. 1. The arrangement of FIG. 1B does not provide increased latent cooling over the arrangement of FIG. 1A, rather, the sensible cooling portion is cancelled by the reheat coil so that only the latent dehumidification portion is delivered to the conditioned space.

Figure 2A:
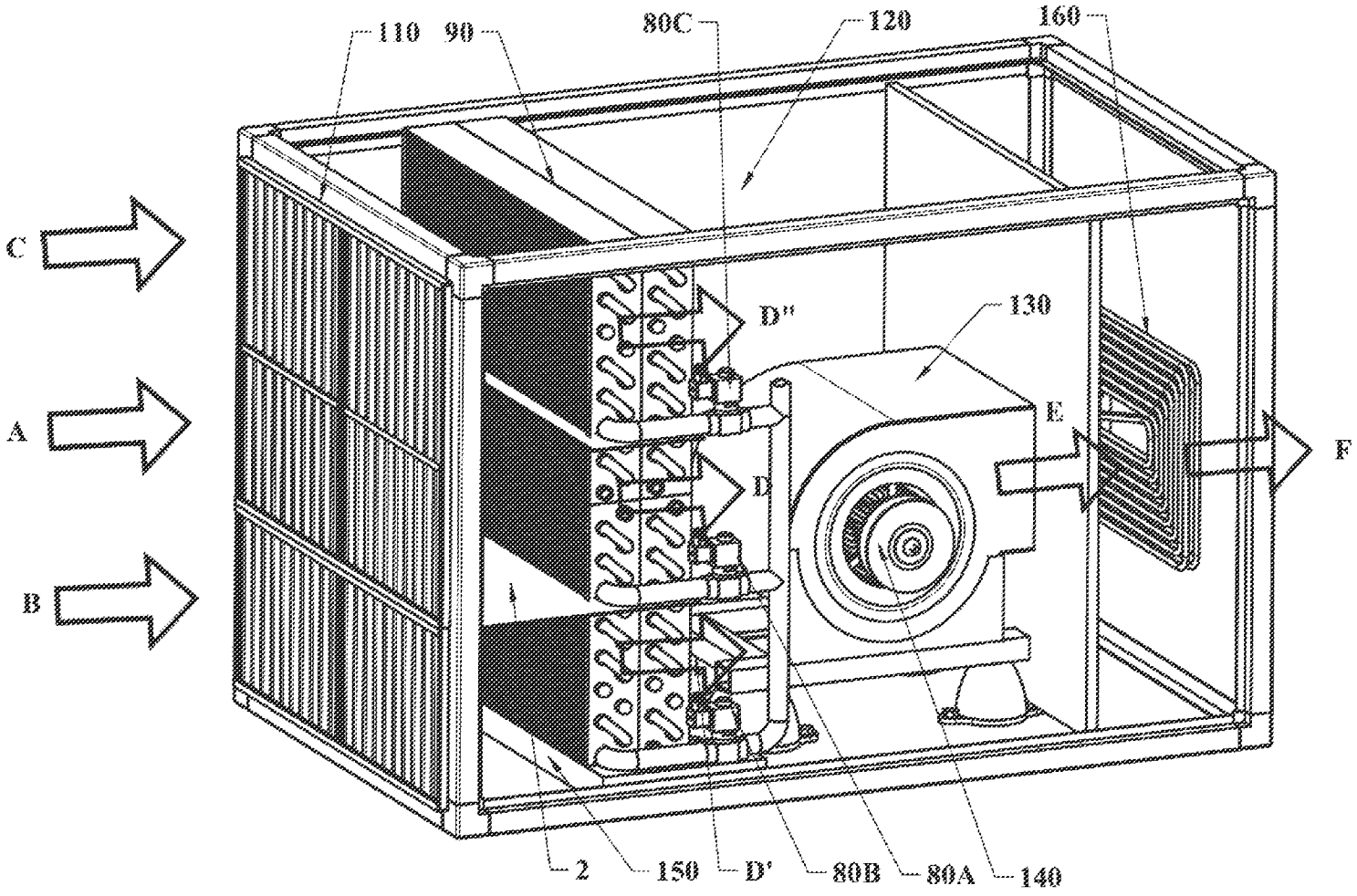
FIG. 2A and FIG. 2B show an embodiment of the structure of an air-conditioning unit with segmented heat-exchanger coil segments, according to one embodiment of the present invention, which could be used in connection with the direct expansion system depicted in FIG. 1.
Figure 2B:
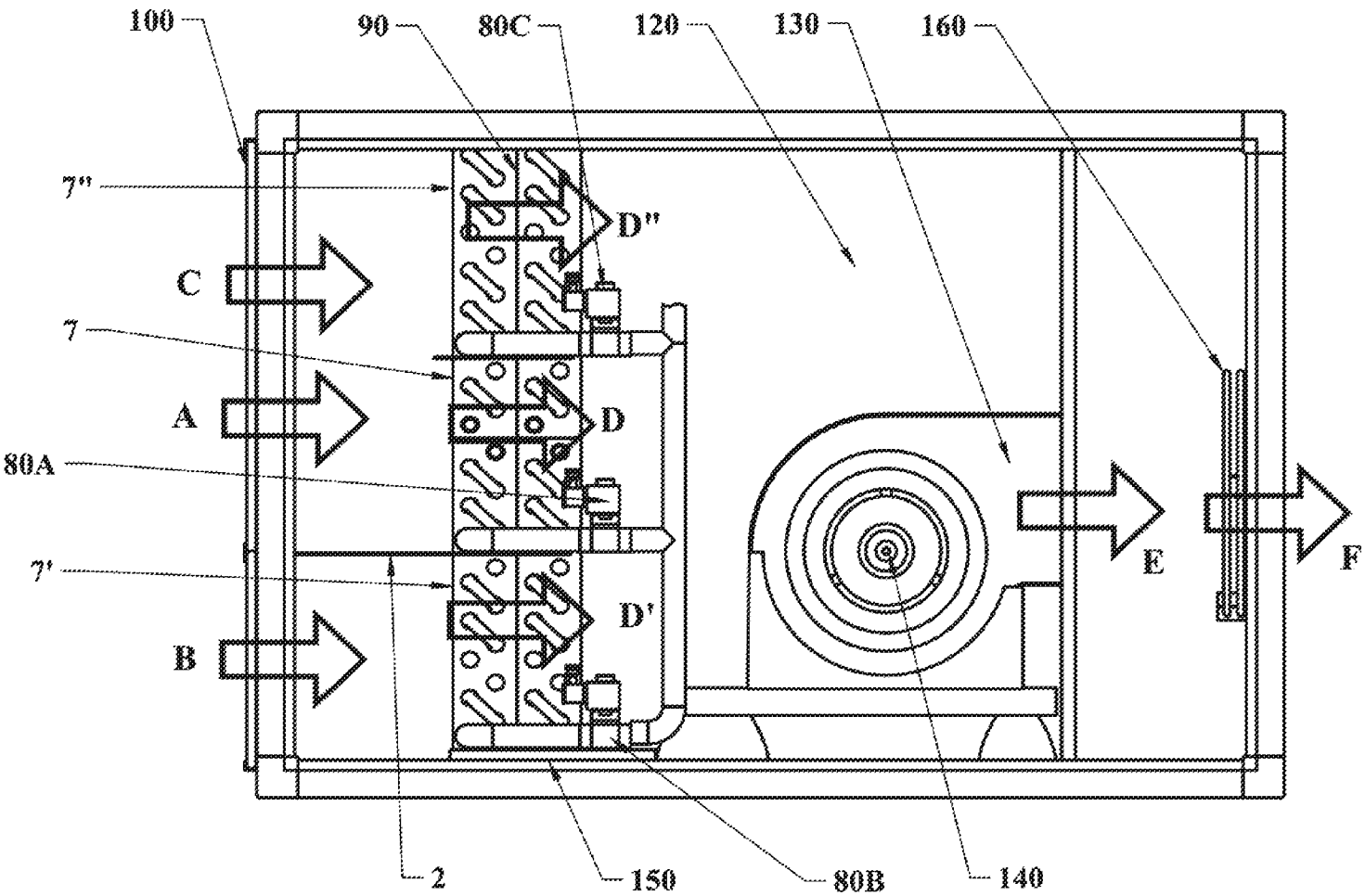

FIGS. 2A and 2B shows two views of an embodiment 100 of the structure of an air conditioning unit with segmented heat-exchanger coil 70 having sections 7, 7' and 7" according to an embodiment of the present invention, which may be used in connection with the direct expansion system 1 depicted in FIG. 1 to condition the air in an enclosed space.

In one embodiment 100, depicted at least in FIGS. 2A and 2B, return air from the controlled space or ambient air flows along path A through filter 110, and fresh air or air from outdoors flows along path B, which can be separated from path A, through filter 110. Filter 110 can be a single physical filter or can be one or more descrete physical filters.

The return or ambient airflow A and fresh or outside airflow B can be prevented from mixing by partition 2, which directs the fresh or outside airflow B through segment 7' of Heat-exchanger coil 70 along air flow path D', and the return or ambient air through heat-exchanger coil segment 7 and/or 7" of heat-exchanger coil 70, along air flow path D and/or D". In this way, both the quantity and efficiency of the dehumidification achieved is increased.

The segments 7, 7' and 7", of the heat-exchanger coil 70 may or may not be similar in construction, depth, or fin spacing and arrangement, and can be separate fin-tube heat-exhangers. There may be two, three, or more segments of the heat-exchanger coil.

Each or any of the heat-exchanger coil segments 7, 7', and 7" can be cooled by circulating refrigerant as shown in FIG. 1 or by chilled liquid, such as but not limited to water or glycol, as would be known to those skilled in the art.

The heat-exchanger coil 70 can be separated into more than two sections where circulating refrigerant or chilled liquid through one or more sections can be controlled by one or more valves 80. The distinction between heat-exchanger coil section 7 and 7' of Evaporaotr 70 may be limited to the physical portion of the heat-exchanger coil referred to. Heat-exchanger coil sections 7 and 7' can be separated by valves 80.

Refrigerant may flow through sections 7, 7', and 7" of heat-exchanger coil 70. One or more valves 80 as shown in FIG. 2 can control whether or not any refrigerant or chilled liquid is permitted, or the amount of refrigerant or chilled liquid permitted to flow through any segment of heat-exchanger coil 70, while refrigerant can always flow through one or more segments of heat-exchanger coil 70.

In one embodiment valve 80C can control whether or not refrigerant is permitted to flow through segment 7" of the heat-exchanger coil 70, while refrigerant can always flow through segments 7 and 7' of the heat-exchanger coil 70. In another embodiment, valves 80C and 80A can control whether or not refrigerant is permitted to flow through segments 7" and 7, respectively of coil 70, while refrigerant can always flow through segment 7' of the heat exchange coil.

Valves 80 can be positioned in a refrigerant or chilled fluid line entering or exiting the heat-exchanger coil. Valves 80 can be positioned at the inlet of a segment of heat-exchanger coil 70, at the outlet of a segment of heat-exchanger coil 70, or upstream or downstream of the expansion device 50.

In one embodiment, valve 80C can be positioned at the inlet of segment 7" of the heat-exchanger coil 70, and another valve 80A can be optionally be positioned at the inlet of segment 7 of the heat-exchanger coil 70. Valve 80C can be controlled by the controller 500 and can be adjusted to direct refrigerant to enter into segment 7" of the heat-exchanger coil 70 or can be adjusted to direct refrigerant to bypass segment 7" of the heat-exchanger coil 70 and flow only through segment 7 and 7' of the heat-exchanger coil 70.

Valves 80 can be controlled by the controller 500 and can be adjusted to allow refrigerant to flow through segments 7, 7' and/or 7" of heat-exchanger coil 70 or can be positioned to allow refrigerant that has bypassed any segment of heat-exchanger coil 70 to enter only segment 7, 7' and/or 7" of heat-exchanger coil 70.

Referring to FIGS. 2A and 2B, the portion of cooling directed to the airflow through segment 7" of heat-exchanger coil 70 along path D" relative to the portion of cooling directed to the airflow of ambient or return and fresh or outside air through air flow paths D and D' can be varied by controlling the valve 80C, which determines how much, if any, refrigerant may flow through segment 7" of heat-exchanger coil 70. Valves 80A, 80B and 80C can be controlled by the controller 500 and the electrical control signal can be physically secured to the terminal strip 520 in FIG. 5B.

Figure 5A:
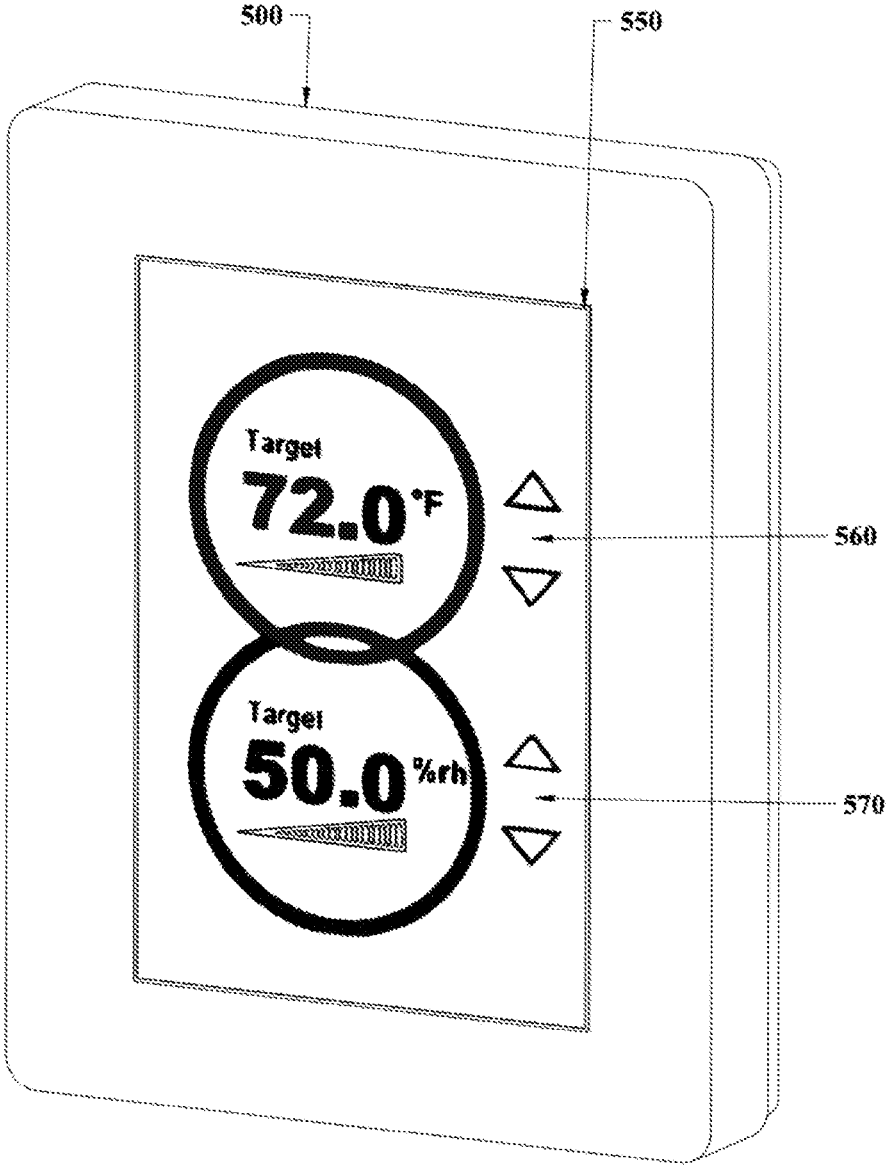
FIG. 5A is a front view of an embodiment of user selectable temperature and humidity set point controls to control components shown in FIGS. 1, 2A, 2B.
Figure 5B:
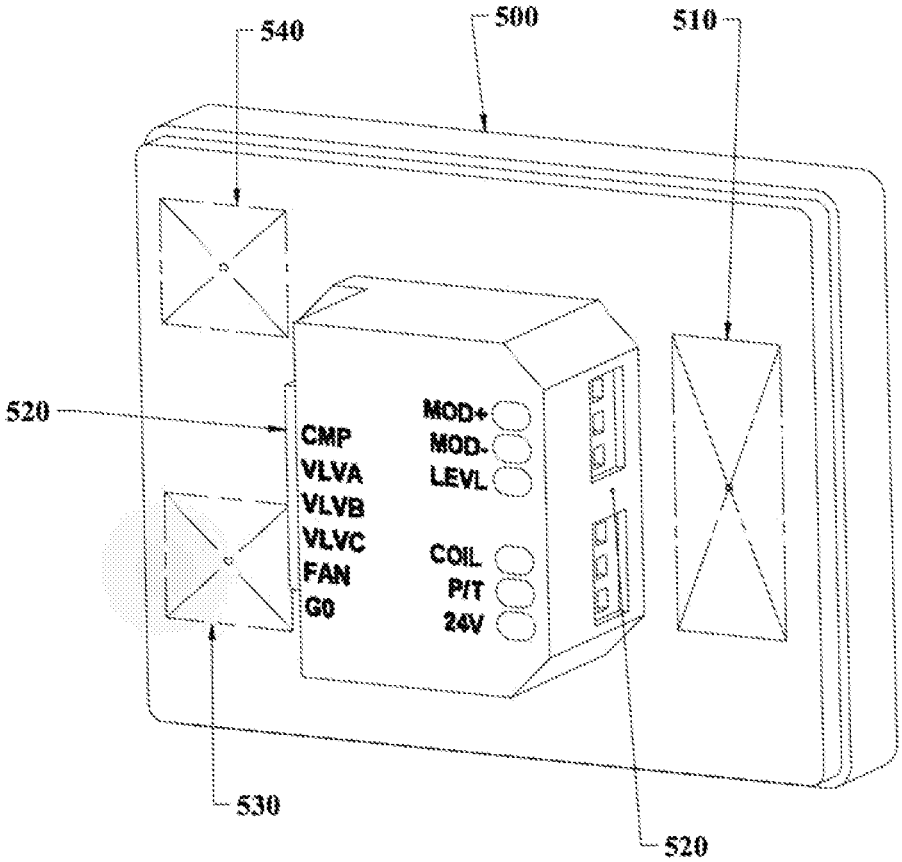
FIG. 5B is a rear view of an embodiment of user selectable temperature and humidity set point controls to control components shown in FIGS. 1, 2A, 2B.

Return or ambient air entering the unit along air flow path A can flow past segment 7" of heat-exchanger coil 70 along path D" and past segment 7 of the heat-exchanger coil 70 along path D. Air flow following path D" can mix with the air flow exiting heat-exchanger coil 70 along paths D and D' in an output mixing plenum 120. A fan 130 can be located within the plenum 120 and be driven by fan motor 140, which can be single speed, multi-speed, or variable speed. The fan motor 140 can be controlled in response to a command from controller 500, which is depicted in FIGS. 5A-5B, via wiring connectors on terminal strip 520.

Referring to FIGS. 2A and 2B, water vapor in the fresh, outside, ambient, return air and/or a mixture of air can condense in heat-exchanger coil segments 7, 7', or 7" and in plenum 120. This condensation can be collected in condensate collection pan 150.

Fan 130 can provide a pathway E for air to exit plenum 120. After exiting plenum 120, air can travel past heating coil 160. The heating coil 160 can be energized in response to a command from the controller 500. The electrical control for the heating coil 160 can be secured to terminal strip 520. Air can flow through the heating coil 160 along air flow path F to raise its temperauture if controller 500 determines that heating is required.

Fan 130 can be placed in any suitable location for achieving air flow without departing from the inventive principles, such as upstream of the mixing plenum, inside the mixing plenum, or downstream of the mixing plenum. The controller 500 can produce a fan control signal as a continuous signal or as one more discrete signals.

Figure 3:
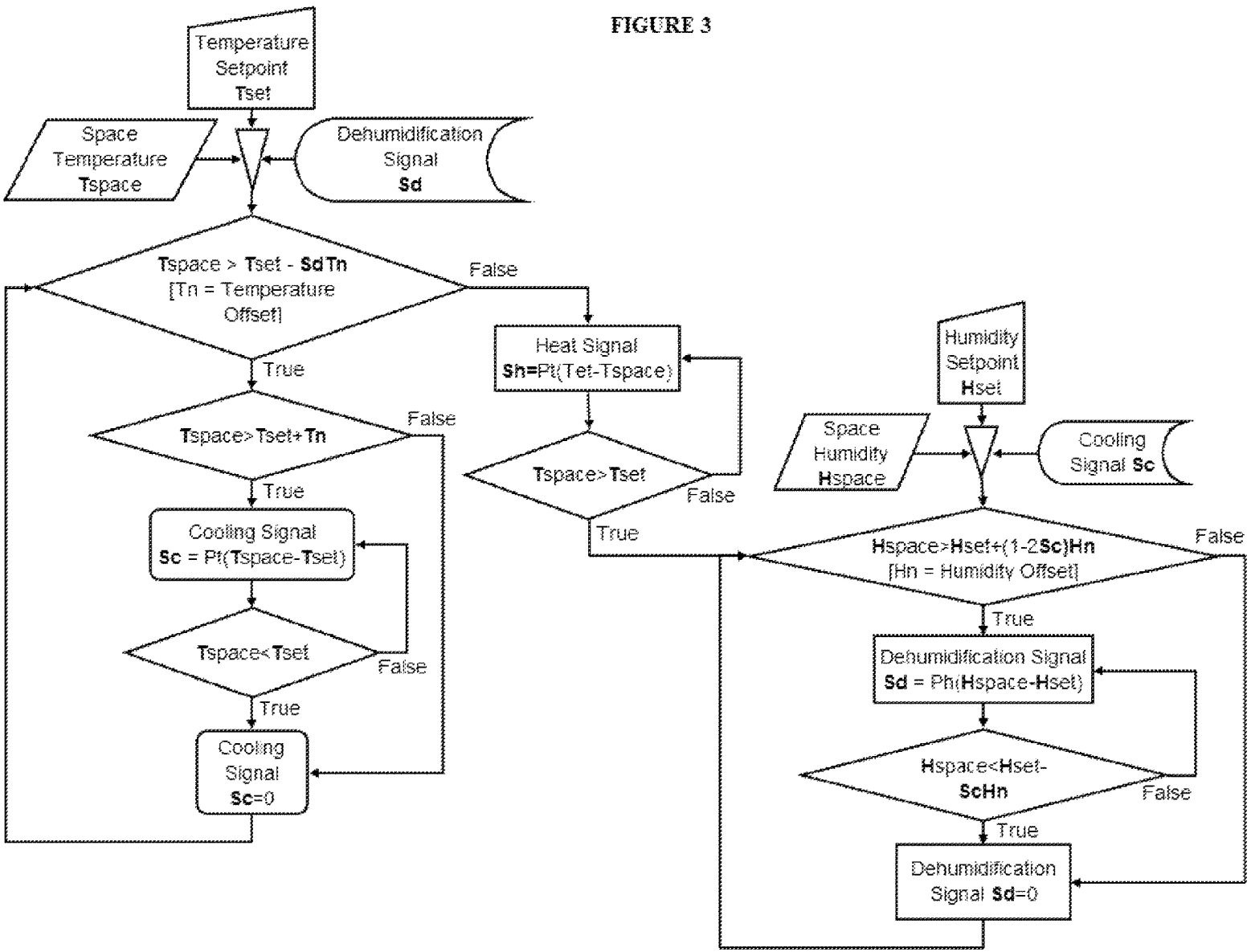
FIG. 3 is a flowchart of an embodiment of a control sequence for use with the air conditioning unit of FIG. 1 and FIG. 2, when applied to control of a system such as a direct expansion split-system, chilled fluid system, or packaged air-conditioner unit.

FIG. 3 is a flowchart of a control sequence according to one embodiment, which can be utilized to control a discrete state type system including, but not limited to a direct expansion type system, such as a split-system or packaged unit, or modulating or variable type of a system, such as a variable speed direct expansion system or a chilled water system with control unit 500. Referring to FIG. 3, dehumidification signal Sd, cooling signal Sc and heating signal Sh responsive primarly to but not exclusively to space humidity Hspace and space temperature Tspace are calculated by software running on controller 500.

Controller 500 executes the control sequence of FIG. 3 and PID, binary search, P-adaptive, relational or other type of logic software functions to satisfy set points, as known to those skilled in the art. Each of the signals output by controller 500 can be used to turn on and/or modulate or turn off heat-exchanger coil 70, open and/or modulate or close valves 80, 80B, and/or 80C, turn on or off or vary the speed of fan 130, or turn on and/or modulate or turn off heating coil 160.

As shown, humidity control signal Sd is output separately or independently from temperature control signal Sc and heat-exchanger coil segments 7 and 7' are operable to cool and dehumidity intake air flows A and B separately from heat exchange coil segment 7" that is operable to cool and dehumdiify intake air flow C.

In one embodiment, room temperature Tspace can be sensed by temperature sensor 540, which can be, by way of example and not as a limitation, an integrated resistive type sensor, and room humidity Hspace can be sensed by humidity sensor 530 having a current or voltage output proportional to relative humitidy. Temperature set point Tset and humidity set point Hset can be user selectable as shown in FIG. 5A. The variables Tn and Hn are pre-programmed offset values that can define a control operating deadband, the purpose of which is to prevent short cycling by setting a gap between 'on' and 'off' temperature or humidity thresholds. Short cycling may also be prevented by a delay timer.

When cooling is not needed, as determined by the control logic, the cooling signal Sc can be equal to zero and, when full cooling is needed, Sc can be equal to the value one. When dehumidification is not needed, as determined by the control logic, the dehumidification signal Sd is equal to zero and when full dehumidification is needed, Sd can be equal to the value one.

The capability for reheat is shown to allow for the condition whereby Sd>0 triggers heat in response to a critically high humidity in conjunction with a critically low temperature. Connection between temperature and humidity control loops trigger the recalculation of the dehumidification Signal Sd, based on humidity alone. Simply put, following the process of FIG. 3, if the value Sh=0, Sd is calculated solely on the basis of humidity. This embodiment of the system can simulatenously optimize both temperature and humidity in accordance with the purpose of the air conditioning system.

In the inventive method depicted in FIG. 3, the outputs Sd, Sc, and Sh can take any value between 0.0 and 1.0, which provide proportional, integral (PI), and/or derivative (PID), relational, P-adaptive, or other type of control. With proportional (P) control as shown in FIG. 3 the magnitude of control signals Sd, Sc, and Sh are based on the differences between Tspace and Tset, and between Hspace and Hset. In the case of a discrete system without capability for modulation or speed variation, the outputs Sd, Sc, and Sh can be limited to take only values 0.0 and 1.0. With proportional-integral control (PI) the signals are based on the differences and the length of time the offsets have existed, which is the difference integrated over time. With proportional-integral-derivative control (PID) the signals are based on the difference, the integrated difference, and the rate at which the difference is changing, which is the time derivative of the difference.

In this manner, the control logic sets the amount of cooling provided by coil segments 7, 7' and 7" of heat-exchanger coil 70, the amount of heating provided by coil 160, the poisition of valves 80, 80B, 80C, and the speed of fan 130 to vary the amount of sensible cooling relative to latent cooling in order to satisfy the user selectable temperature set point and humidity set point quickly while consuming minimum energy.

According to the inventive principles as disclosed herein, the operation of the system can be discrete or modulating, with all of the operating parts made to respond to discrete on or off signals or modulating variable signals, as would be known to one skilled in the art.

Figure 4A:
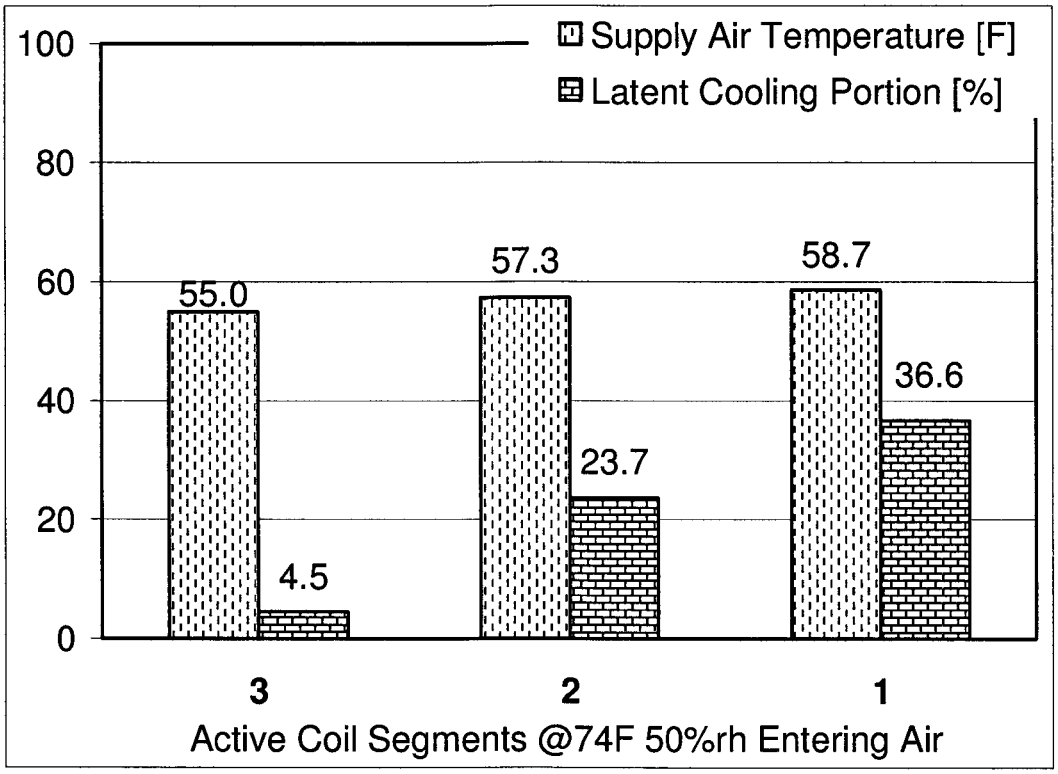
FIG. 4A is a graph of supply air temperature measured at location E and the latent cooling portion verses the number of active heat-exchanger coil segments.

FIG. 4A is a graph of supply air temperature measured at location E and the latent cooling portion verses the number of active heat-exchanger coil segments. The data shows an increase in dehumidification provided, which is latent cooling increasing from approximately 4.5% to approximately 36.6%, as the number of active segments is decreased from 3 to 1 according to the invention, and the quantity of sensible cooling decreases as supply air temperature increases from approximately 55.0 to approximately 58.7 F. Existing systems utilizing prior art would produce data similar to three (3) segments active. The air inlet corresponds to a psychometric condition of approximately 74 F temperature, approximately 50% relative humidity, approximately 62 F wet-bulb, and approximately 63 grains of moisture per pound of dry air absolute humidity.

Figure 4B:
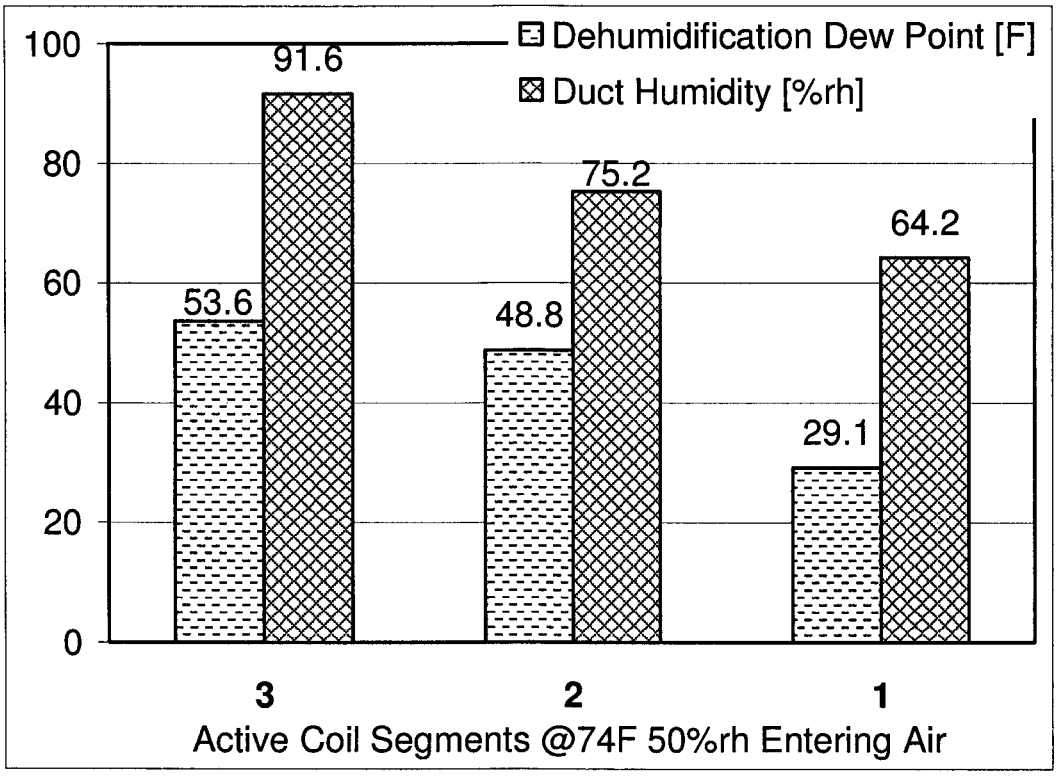
FIG. 4B is a graph of dehumidification dewpoint and supply duct relative humidity verses the number of active heat-exchanger coil segments.

FIG. 4B is a graph of dehumidification dewpoint and supply duct relative humidity verses the number of active heat-exchanger coil segments. The data shows a decrease in dewpoint of air leaving the active segments, which means much drier air, from approximately 53.6 to approximately 29.1 Fdp, as the number of active segments is decreased according to the invention, and the humidity of the supply air decreases from approximately 91.6% to approximately 64.2%. Existing systems utilizing prior art have a dewpoint of approximately 55 Fdp and supply air humidity in excess of approximately 95%.

Figure 4C:
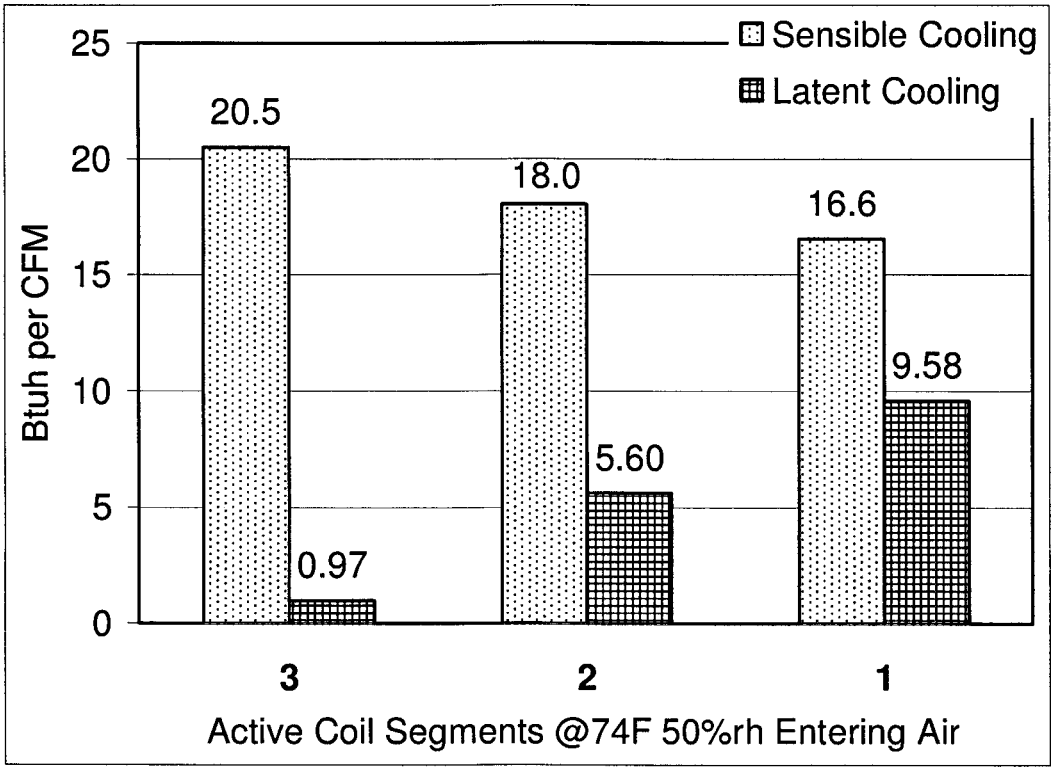
FIG. 4C is a graph of Relative humidity of Supply air (RH) sensible cooling and latent cooling verses the number of active heat-exchanger coil segments.

FIG. 4C is a graph of sensible cooling and latent cooling verses the number of active heat-exchanger coil segments. Sensible cooling decreases the temperature of the space, while latent cooling decreases the humidity of the space. The data shows a large increase in latent cooling from approximately 0.97 to approximately 9.58 Btuh/cfm, as the number of active segments is decreased according to the invention, with a concurrent decrease in sensible cooling from 20.5 to 16.6 Btuh/cfm, which greatly increases dehumidification and reduces space humidity. At full dehumidification at these constant air inlet conditions, the present invention provides nearly ten fold increase in dehumidification capability over conventional systems.

Figure 4D:
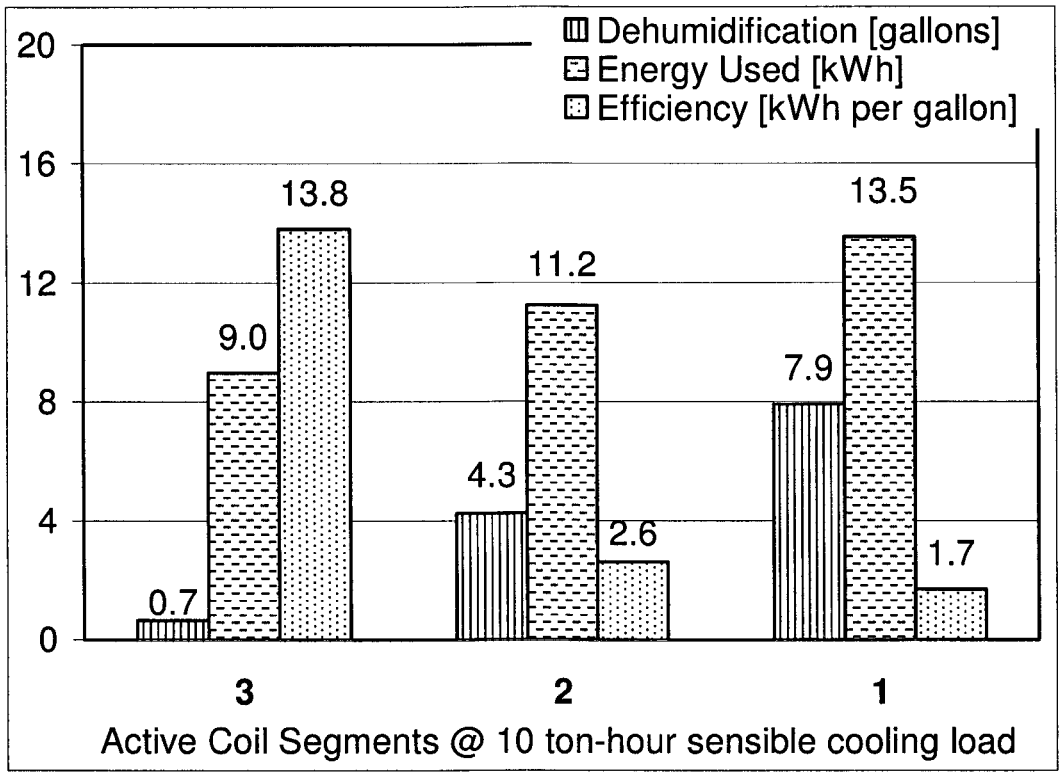
FIG. 4D is a graph of dehumidification, energy used, and dehumidification energy efficiency in meeting a sensible cooling load of 10 ton-hours, verses the number of active heat-exchanger coil segments.

FIG. 4D is a graph of dehumidification, energy used, and dehumidification energy efficiency in meeting a sensible cooling load of approximately 10 ton-hours, verses the number of active heat-exchanger coil segments. Dehumidification increases from approximately 0.7 to approximately 7.9 gallons of moisture, as the number of active segments is decreased according to the invention, with a concurrent increase in energy consumed from approximately 9.0 to approximately 13.5 kWh. The dehumidification gains as the number of active segments are decreased is large relative to the energy use increase, thus dehumidification energy efficiency improves from approximately approximately 13.8 to approximately 1.7 kWh per gallon, an approximately 88 percent improvement.

FIGS. 5A and 5B depicts one embodiment of a control unit with user selectable temperature and humidity set point controls and connections according to an embodiment of the invention. Additional embodiments of control unit 500 that may carry out the control logic of FIG. 3 can include, but are not limited to programmable logic controllers, thermostats, embedded computers, direct-digital controllers (DDC), building automation systems (BAS), energy management control systems (EMCS), or general purpose computers.

The temperature set point controls 560 and the humidity set point controls 570 can be independently adjusted by the user. Depressing a down arrow button can lower a setting and depressing an up arrow button can raise a setting. The specific settings can be visually displayed on a display on control unit 500.

Control unit 500 can contain or have provisions for connection of temperature sensor 540 and humidity sensor 530 to carry out the control sequence of FIG. 3. Terminal strip 520 can physicaly connect with and transmit analog and/or digital signals to and from system components including valves 80, pressure-temperature sensor 60, level sensor 65, compressor 30 or other cooling means, fan motor 140, and/or an external device such as a unit controller or a building automation system.

In the case of a direct expansion refrigeration system, cooling means adjustment can be achieved by unloading, reducing speed, or turning off one or more compressors. In the case of a chilled fluid system cooling means adjustment can be achieved by modulating or interrupting the flow of chilled fluid.

Humidity and temperature can be independently measured by separate and independent humidity sensor 530 and temperature sensor 540, which output via signals Hspace and Tspace, respectively, which can be transmitted to the controller 500. Any suitable humidity sensor 530 known to one skilled in the art can be used, including, but not limited to, a sensor using a humidity sensitive polymer on a porous ceramic plate. The operation of the humidity sensor 530 can be independent of temperature and depend on the resisitivity of the polymer changing as a function of relative humidity. However, as would be understood by those skilled in the art, the invention and the inventive principles are not limited to the particular type of relative humidity sensor 530 chosen.

Controller 500 can receive humidity and temperature information from humidity sensor 530 and temperature sensor 540, and control valves 80 in response to the sensed humidity and temperature compared with the humidity setpoint and the temperature setpoint. As an example, the more humidity needs to be reduced, the less refrigerant is allowed to flow through segment 7" of heat-exchanger coil 70. Similarly, when less dehumidification is required, more refrigerant is allowed to flow through segment 7" of heat-exchanger coil 70.

The controller 500 can be programmed to execute the control sequence logic of FIG. 3, depending on the type of system being controlled, and provide output command signals at terminal strip 520, which are produced by the controller 500 via separate and independent dehumidification signal Sd. temperature signal Sc, and heating signal Sh.

There can be a MaxHumidity set point and a MinHumidity set point in the controller 500 shown in FIG. 5A. When the humidity sensed by sensor 530 is equal to the MaxHumidity set point, the smallest amount of refrigerant or chilled liquid possible, which can be no refrigerant or chilled liquid, is allowed to flow through segment 7" of heat-exchanger coil 70. When the humidity sensed by sensor 530 is equal to the MinHumidity set point, the greatest amount of refrigerant of chilled liquid possible is allowed to flow through segment 7" of the heat-exchanger coil 70. The amount of refrigerant or chilled liquid flowing through segment 7" of the heat-exchanger coil 70 when the humidity sensed by humidity sensor 530 is between MaxHumidity and MinHumidity can be inversely proportional to the difference between the value of the sensed humidity and the humidity setpoint.

Controller 500 can receive temperature infromation from temperature sensor 540 and control optional valve 80A in response to the sensed temperature. The more temperature needs to be reduced, the more cooling is directed to segment 7 of Heat-exchanger coil 70. Similarly, when less sensible cooling is required, less cooling is directed to segment 7 of heat-exchanger coil 70. Referring to FIGS. 2 and 7, the portion of cooling directed to the airflow through segment 7 of heat-exchanger coil 70 along path D relative to the portion of cooling directed to the airflow of fresh or outside air through air flow path D' can be varied by controlling optional valve 80A, which determines how much, if any, refrigerant may flow through segment 7 of heat-exchanger coil 70.

There can be a temperature setpoint and a temperature offset. When the temperature sensed by sensor 540 is equal to setpoint minus offset, the smallest amount of refrigerant possible, which can be no refrigerant, is allowed to flow through segment 7 of the heat-exchanger coil 70. When the temperature sensed by temperature sensor 540 is equal to setpoint plus offset, the greatest amount of refrigerant possible is allowed to flow through segment 7 of the heat-exchanger coil. The amount of refrigerant flowing through segment 7 of the heat-exchanger coil 70 when the temperature sensed by sensor 540 is between setpoint minus offset and setpoint plus offset can be directly proportional to the difference between the value of the sensed temperature and the temperature setpoint.

Benefits and objectves of the present invention can include:

Selectable heat-exchanger coil segments to control the relative amounts of cooling and dehumidification provided by the system by controlling the number of active segments, and the relative flow of coolant to each segment.

Liquid-suction heat-exchanger separator to provide the coldest possible heat-exchanger coil and maximum amount of dehumidification, while preventing compressor damage and improving energy efficiency Control of refrigerant flow according to the level of liquid refrigerant in the separator to maximize heat exchange effectiveness and improve operational stability Refrigerant entering the compressor at zero or near-zero superheat condition to improve compressor efficiency and longevity.

Separation of return or ambient airflow from outside or fresh airflow, so that the flows do not mix before entering the heat-exchanger coil, to increase dehumidification capability.

Some of the illustrative aspects of the present invention can be advantageous in solving the proclems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

The term "approximately"/" approximate"/" about" can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112 (f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An air conditioning system with adjustable cooling and heating and humidity control for a controlled space, consisting of:

a compressor;

a condenser connected to the compressor to provide a liquid refrigerant flow;

a controllable segmented heat-exchanger for cooling airflow where coil segments are stacked and parallel with each other, the controllable segmented heat-exchanger coil includes separate valves for controlling each of the segments according to sensed temperature and humidity levels;

a controller for controlling relative flow of refrigerant to the coil segments;

a liquid-suction heat-exchanger separator for cooling of a first refrigerant flow from the condenser, and for vaporizing by heating of a second refrigerant flow from the segmented heat-exchanger; where the liquid-suction heat-exchanger separator includes a vessel with a hollow coil tube spiraled between a top and bottom of the vessel, wherein the first refrigerant flow is passed through the hollow spiraled coil tube to subcool it, and the second refrigerant flow is passed around the hollow tube spiraled coil to heat and vaporize it;

a sensor at a vapor outlet of the liquid-suction heat-exchanger separator for sensing at least one of pressure and temperature so that flow rate, and thus the pressure, is reduced when refrigerant flow is not sufficiently superheated, and the flow rate is increased as the superheat becomes adequate, the sensor selected from a group consisting of a temperature sensor, a pressure sensor and a pressure and temperature sensor; and an electronic liquid level sensor attached to the liquid-suction heat-exchanger separator for controlling an expansion device so said vessel is adequately filled with liquid.

2. An air conditioning system with adjustable humidity control for a controlled space, consisting of:

a compressor;

a condenser connected to the compressor to provide a liquid refrigerant flow;

a controllable segmented evaporator coil for cooling airflow where coil segments are stacked and parallel with each other, the controllable segmented heat-exchanger coil includes separate valves for controlling each of the segments according to sensed humidity level;

a controller for controlling relative flow of refrigerant to each of the coil segments so that adjustable humidity control is provided; and a liquid-suction heat-exchanger separator for cooling of a first refrigerant flow from the condenser to an expansion device, and for vaporizing by heating of a second refrigerant flow from said controllable segmented evaporator; wherein the liquid-suction heat-exchanger has at least four refrigerant tube connections including high-pressure inlet and liquid outlet, and low-pressure inlet and vapor outlet;

an electronic liquid level sensor attached to said liquid-suction heat-exchanger separator for controlling an expansion device so said liquid-suction heat-exchanger separator is adequately filled by ensuring a substantial flow of liquid refrigerant exiting the evaporator, without superheating the refrigerant vapor entering the compressor; and a control for decreasing the plurality of the active coil segments, wherein a decrease in the number of the plurality of active coil segments causes an increase in dehumidification capability of the system.

3. The air conditioning system of claim 2, wherein the plurality of active coil segments includes three active coil segments.

4. An air conditioning system with cooling and heating and humidity control for a controlled space, consisting of:

a compressor;

a condenser connected to the compressor to provide a liquid refrigerant flow;

a controllable segmented heat-exchanger for cooling airflow where coil the segments are stacked and parallel with each other;

one or more valves for controlling flow of refrigerant to the segments according to sensed temperature and humidity levels;

a control for decreasing the number of the active coil segments, wherein a decrease in number of active coil segments causes an increase in amount of dehumidification and the dehumidification energy efficiency of the system;

a liquid-suction heat-exchanger separator for cooling of a first refrigerant flow from the condenser, and for vaporizing by heating of a second refrigerant flow from the segmented heat-exchanger; wherein the liquid-suction heat-exchanger separator has at least four refrigerant tube connections including high-pressure inlet and liquid outlet, low-pressure inlet and vapor outlet, and includes a vessel with a hollow coil tube spiraled between a top and bottom of the vessel; wherein the first refrigerant flow is passed through the hollow spiraled coil tube to cool it, and the second refrigerant flow is passed around the hollow tube spiraled coil to vaporize it by heating; and an electronic liquid level sensor attached to the liquid-suction heat-exchanger separator for controlling an expansion device so said vessel is adequately filled with liquid to ensure a substantial flow of cold liquid refrigerant entering the segmented heat-exchanger from the expansion device;

a humidity sensor for providing sensed humidity;

a temperature sensor for providing sensed temperature, wherein the sensed humidity and the sensed temperature are compared with a humidity setpoint and a temperature set point, so that adjustable humidity and temperature control is provided; and a temperature-pressure sensor in combination with the liquid level sensor, to control the expansion device so that refrigerant flow entering the compressor has zero degrees superheat and the liquid-suction heat-exchanger separator vessel is adequately but not over filled with liquid refrigerant.

5. The air conditioning system of claim 4, wherein the plurality of active coil segments includes three active coil segments.

6. The air conditioning system of claim 5, wherein the amount of dehumidification increases by approximately ten times, when number of active coil segments is decreased from three active coil segments to one active segment.

7. The air conditioning system of claim 5, wherein the amount of dehumidification increases by approximately six times, when number of active coil segments is decreased from three active coil segments to two active segments.

8. The air conditioning system of claim 5, wherein dehumidification energy efficiency increases by approximately eight times when number of active coil segments is decreased from three active coil segments to one active coil segment.

9. The air conditioning system of claim 5, wherein dehumidification energy efficiency increases by approximately five times when number of active coil segments is decreased from three active coil segments to two active coil segments.

10. An air conditioning system with adjustable cooling and heating and humidity control for a controlled space, consisting of;

a compressor;

a condenser connected to the compressor to provide a liquid refrigerant flow;

a controllable segmented heat-exchanger for cooling airflow where coil segments are stacked and parallel with each other;

a controller for controlling relative flow of refrigerant to the coil segments;

a liquid-suction heat-exchanger separator for cooling of a first refrigerant flow from the condenser, and for vaporizing by heating of a second refrigerant flow from the segmented heat-exchanger; where the liquid-suction heat-exchanger separator includes a vessel with a hollow coil tube spiraled between a top and bottom of the vessel, wherein the first refrigerant flow is passed through the hollow spiraled coil tube to subcool it, and the second refrigerant flow is passed around the hollow tube spiraled coll to heat and vaporize it; and an electronic liquid level sensor attached to the liquid-suction heat-exchanger separator for controlling an expansion device so said vessel is adequately filled with liquid, wherein the liquid-suction heat-exchanger separator allows the coldest possible segmented heat-exchanger before freezing, and thus maximum dehumidification, while also preventing damage to the compressor, increasing compressor longevity and improving energy efficiency.

* * * * *